United States Patent [19]

Chapin et al.

[11] 4,077,802

[45] Mar. 7, 1978

[54] SINGLE COLOR ELECTROPHOTOGRAPHIC COPY PROCESS

[75] Inventors: Leo N. Chapin, Des Plaines; Young Rhee, Chicago, both of Ill.

[73] Assignee: A. B. Dick Company, Niles, Ill.

[21] Appl. No.: 380,567

[22] Filed: Jul. 19, 1973

Related U.S. Application Data

[63] Continuation of Ser. No. 94,124, Dec. 1, 1970, abandoned.

[51] Int. Cl.[2] ..... G03G 13/22

[52] U.S. Cl. ..... 96/1 R; 96/1 LY; 96/1.2; 96/1.4; 427/24; 101/DIG. 13

[58] Field of Search ..... 96/1 R, 1 LY, 1.2, 1.4; 117/17.5, 37 LE

[56] References Cited

U.S. PATENT DOCUMENTS

| | | | |
|---|---|---|---|
| 2,949,848 | 8/1960 | Mott | 96/1.4 X |
| 2,954,291 | 9/1960 | Clark | 96/1 R |
| 3,630,729 | 12/1971 | Bach et al. | 96/1.2 |
| 3,681,065 | 8/1972 | Sato et al. | 96/1.2 |
| 3,716,360 | 2/1973 | Fukushima et al. | 96/1 LY X |
| 3,728,112 | 4/1973 | Chapin et al. | 96/1.2 |
| 3,754,907 | 8/1973 | Chapin | 96/1.2 X |

*Primary Examiner*—Roland E. Martin, Jr.

[57] ABSTRACT

This invention is addressed to a single color electrophotographic copy process in which a receptor having a photoconductive coating comprising a photoconductor, at least one sensitizer which sensitizes the photoconductor to at least a portion of the spectrum of visible light, a binder and a dispersed dye on the face thereof is charged and exposed to an original whereby the portion of the photoconductive coating corresponding to the non-imaged areas of the original are discharged leaving a latent electrostatic image on the receptor and then the exposed receptor is developed with a toner in the form of a material which, when in an activated state acts as a solvent or adhesive for the dispersed dye in the photoconductive coating for transfer of the dye color in the photoconductive coating in response to surface contact of the developed receptor with a copy sheet.

22 Claims, 4 Drawing Figures

INVENTORS
Leo N. Chapin
Young Rhee
by McDougall, Hersh
and Scott Attys

SINGLE COLOR ELECTROPHOTOGRAPHIC COPY PROCESS

This is a continuation of application Ser. No. 94,124, filed Dec. 1, 1970, now abandoned.

This invention relates to a new electrophotographic copy process for the production of single color copies.

A well known electrophotographic copy process, generally referred to as the Xerox process, is described in U.S. Pat. No. 2,297,691 to Carlson, in which a receptor having a photoconductive coating or layer is given a blanket electrostatic charge under subdued light or in the dark, such as by ion transfer from a corona discharge. Thereafter, the photoconductive coating or layer is exposed to light modified by an image, such as by projection of a photographic image onto the photoconductive layer. The illuminated areas of the photoconductive layer, corresponding to the non-imaged areas of the original, are rendered conductive whereby the illuminated areas are discharged to leave a latent electrostatic image on the photoconductive coating or layer corresponding to the imaged portions of the original.

The resulting latent electrostatic image can then be developed, as by dusting with an electroscopic powder, such as a pigmented resinous powder carrying an electrostatic charge whereby the powder is attracted to the oppositely charged latent electrostatic image, as is described in U.S. Pat. Nos. 2,618,551, 2,788,288 or 2,940,934. Development of the latent electrostatic image can also be achieved by use of a liquid developing composition of the type described in U.S. Pat. Nos. 2,877,133, 2,891,911 and 2,907,674. In either case, the powder or pigment of the powder or liquid developer, often referred to as toner, adheres to the electrostatically charged latent image.

The resulting developed image can be used in a variety of ways. For example, it can be fixed to form the image directly on the photoconductive coating or layer on the receptor, or it can be transferred from the photoconductive coating on the receptor to a copy sheet to be fixed on the copy sheet.

Regardless of whether use is made of a powdered developer or a liquid developer and whether the developed image is fixed on the photoconductive layer or is transferred to a copy sheet, the color of the developed image of necessity corresponds to the color of the pigment powder or liquid developing composition. Thus, when it is desired to change the color of the developed image, it is necessary in the case of single color electrophotographic copy processes heretofore known to use a different toner or developer composition, which involves a number of disadvantages, including the necessity of cleaning the copy machine in order to avoid contamination of the color of the new developer with the color of the old.

In addition, since the developer composition in electrophotographic copy processes of the type described carries the color of the subsequently developed image, such developer compositions are difficult and messy to use, particularly in the case of developer compositions for producing black images.

It is accordingly an object of the present invention to provide a new and improved single color electrophotographic copy process in which the color of the developed image is not carried by the developing composition whereby the developer composition is more convenient to use.

It is a related object of the present invention to provide a new and improved single color electrophotographic copy process in which the color of the developed image can be changed without changing the developer composition and/or toner.

It is another object of the invention to provide a new and improved single color electrophotographic copy process in which it is unnecessary to make use of a specially-treated sheet as the copy sheet.

It is yet a further object of this invention to provide a new and improved single color electrophotographic copy process which is capable of producing copy in the form of transparencies or as direct offset masters without modification of the copy machine and/or supplies.

These and other objects and advantages of the present invention will more fully appear hereinafter, and for purposes of illustration, but not of limitation, an embodiment of the invention is illustrated in the accompanying drawing in which.

Figure 1:
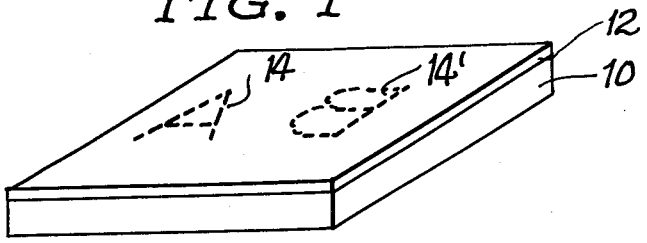
FIG. 1 is a schematic view in perspective of a receptor sheet embodying the concepts of the invention having a latent electrostatic image on the face thereof.

The concepts of the present invention reside in a new and improved single color electrophotographic process which, briefly described, includes the steps of giving a receptor sheet, having a photoconductive coating comprising (1) a photoconductor, (2) an insulating binder, (3) a sensitizing component, and preferably a sensitizing dye which sensitizes the photoconductor to either a selected portion of the spectrum of visible light or to substantially the entire spectrum of visible light, and (4) a pigment or dispersed dye having a color corresponding to the color desired as the image on the copy, an electrostatic charge, and then exposing the receptor to an original whereby the areas of the original having colors corresponding to portions of the spectrum of visible light to which the photoconductor has been sensitized cause corresponding areas on the photoconductive coating to becone conductive, and thereby discharged leaving a latent electrostatic image on the photoconductive coating corresponding to the portions of the original having colors to which the photoconductor has not been sensitized.

The latent electrostatic image thus formed on the photoconductive coating is then developed with either a solid or liquid developer composition formulated to contain a toner in the form of a material which, when in an activated state by the application of heat, a solvent, vapor or the like, serves as a solvent for the dispersed dye in the photoconductive coating or as an adhesive for the photoconductive coating containing the pigment or dispersed dye.

The dispersed dye in the photoconductive coating in the areas corresponding to the areas of the latent electrostatic image can then be transferred to a copy sheet by placing a copy sheet in surface contact with the developed receptor sheet with the application of heat and pressure whereby the dispersed dye or a portion of the photoconductive coating containing the pigment or dispersed dye is transferred to the copy sheet.

Thus, in the electrophotographic single color copy process of this invention, the color of the image on the copy is substantially independent of the toner employed since the color ultimately forming the final copy is contained in the photoconductive coating on the receptor. When it is desired to change the color of the final copy, it is unnecessary to change the particular toner previously employed, since the color reproduced can be changed by simply changing the color of the pigment or dispersed dye in the photoconductive coating, thereby obviating the need to clean the electrophotographic copy machine to avoid color mixing of toners carrying different colors.

In addition, the developed image on the photoconductive coating can be transferred to nearly any substrate, such as a transparent film in the preparation of transparencies or a direct image master from which additional copies can be made by offset or spirit suplication. Depending upon the concentration of dispersed dye in the photoconductive coating and the thickness of the coating, it is frequently possible to obtain more than one copy from a developed receptor, as by passage of successive copy sheets in contact with the developed receptor until the supply of the coloring component in the developed areas is exhausted.

As the photoconductor component of the photoconductive coating, use is preferably made of photoconductive zinc oxide, such as Photox 80 marketed by the New Jersey Zinc Company. However, any of a number of other photoconductors known to those skilled in the art, such as the photoconductors described in U.S. Pat. No. 3,121,006 to Middleton, may also be used.

Similarly, a number of insulating binders are known to the art for use in photoconductive compositions of the type described, and can be used in accordance with the invention. Representative of such binders are organo-silicon resins, butadiene-styrene copolymers, modified alkyd resin (e.g., styrenated alkyd resins), acrylate resins, etc.

As the dispersed dye, use can be made of a number of dyes or mixtures of dyes having a color corresponding to the color desired in the image on the copy sheet, such as blue, black, red and yellow dispersed dyes, as well as a variety of others and mixtures thereof. Representative of such dyes are Nigrosine SSB, Spirit Soluble Fast Blue 6G, Spirit Soluble Fast Red 3B, all from Allied Chemical Company, Azosol Fast Brilliant Red FN from GAF Corporation, Calcofast Spirit Yellow TG and Calcofast Spirit Blue THN from American Cyanamid. As indicated above, use can also be made of a pigment as the coloring component on the photoconductive coating. For this purpose, use can be made of any insoluble pigment including Alkali Blue, Phthalocyanine Blue, etc. As used herein, the term "dispersed dye" is intended to include such pigments as described, it being understood that only when use is made of a toner in the form of a material which, when in an activated state, is a solvent for the coloring component, the coloring component need be a dye which is solubilizable in the activated toner. Otherwise, when use is made of a toner which, when in an activated state, serves as an adhesive for the photoconductive coating, the coloring component need not be solubilizable since the entire coating containing either a dispersed dye or a pigment is transferred to the copy sheet.

In accordance with one embodiment of the present invention, the sensitizing component is a sensitizer or sensitizers which sensitize the photoconductor panchromatically, or to substantially the entire spectrum of visible light. Thus, in accordance with this embodiment of the invention, any image on the original to which the electrostatically charged photoconductive coating is exposed will form a corresponding latent electrostatic image regardless of its color, and thus will appear on the copy sheet in a color corresponding to the color of the dispersed dye.

As the panchromatic sensitizing component, use can be made of a number of sensitizers known to those skilled in the art as being capable of sensitizing photoconductive materials over substantially the entire spectrum of visible light. Preferred sensitizers are sensitizing dyes, and particularly combinations of sensitizing dyes, each of which sensitize the photoconductor to a separate portion of the visible spectrum. Taken together, the combination of all the dyes has the net effect of sensitizing the photoconductor component over the spectrum of visible light.

In formulating such combinations of sensitizing dyes to panchromatically sensitize the photoconductor component, use is made of at least two sensitizing dyes, and preferably three sensitizing dyes. By way of illustration, it is possible to employ a combination of three sensitizing dyes, each of which sensitize the photoconductor to one of the three additive primary colors of red, green and blue. Thus, to provide red sensitivity, use should be made of a sensitizing dye which sensitizes the photoconductor to absorbed light within the range of about 600 to 700 nm, such as Patent Blue (C.I. 42045) from Allied Chemical Company or 3-ethyl-2-[5-(3-ethyl-2-benzothiazolinylidene)-1,3-pentadienyl]-benzothia zolium iodide (referred to in the art as EEBI) from Aldrich Chemical Company.

To provide the desired blue sensitivity, use should be made of a sensitizing dye which sensitizes the photoconductor to absorbed light within the range of about 400 to 500 nm, such as Euchrysine GGA from GAF Corporation or Auramine O from Allied Chemical Corporation.

To provide the desired green sensitivity, use should be made of a sensitizing dye which sensitizes the photoconductor to absorbed light within the range of about 500 to 600 nm, such as Ethyl Red No. 2155 from Eastman Organic Chemicals or Acridine Red (C.I. 45000) from Allied Chemical Co.

Thus, considering the visible spectrum to include light within the range of 400 to 700 nm, the combination of one of each of the foregoing sensitizers has the effect of sensitizing the photoconductor to the entire spectrum of visible light.

When based on the amount of photoconductive zinc oxide, the photoconductive coating used in accordance with the process of the present invention are preferably formulated to contain the components in the following proportions:

| | Parts by weight |
|---|---|
| Photoconductor | 100.0 |
| Binder | 10–200 |
| Sensitizer | 0.001–5.0 |
| Dispersed dye | 0.5–20.0 |

The foregoing proportions are not critical, and are in part dictated by cost factors. For example, the sensitizer component or components can be employed in quantities greater than 5.0 parts by weight per 100 parts by weight of photoconductor, although the costs involved become significant when greater amounts are employed.

The coating is preferably applied in the form of a composition containing the foregoing components in combination with an inert diluent which is a solvent for the resinous binder. Application of the composition is generally made in amounts sufficient to provide a dry coating in a coating weight within the range of 5 to 40 pounds per 3,000 square feet of surface area, and preferably 15 to 30 pounds per 3,000 square feet of surface area.

This embodiment of the invention may be illustrated by reference to the following examples which describe photoconductive compositions in which the photoconductor is panchromatically sensitized.

EXAMPLE 1

| Coating composition (black dispersed dye) | |
|---|---|
| Photoconductive zinc oxide (Photox 80) | 100 g. |
| Modified acrylic resin (50% solids in toluene) (DeSoto resin E-202) | 100 g. |
| Green sensitizing dye (Ethyl Red #2155-Eastman Organic Chemicals) | 0.05 g. |
| Red sensitizing dye (EEBI-Aldrich Chemical Co.) | 0.01 g. |
| Blue sensitizing dye (Euchrysine GGA-Allied Chemical) | 0.25 g. |
| Dispersed dye (Nigrosine SSB-Keystone Aniline & Chemical Corp) | 3.0 g. |
| Toluene | 230 ml. |

EXAMPLE 2

| Coating composition (blue dispersed dye) | |
|---|---|
| Photoconductive zinc oxide (Photox 80) | 100 g. |
| Modified acrylic resin (50% solids in toluene) (DeSoto resin E-202) | 100 g. |
| Green sensitizing dye (Ethyl Red #2155-Eastman Organic Chemicals) | 0.05 g. |
| Red sensitizing dye (EEBI-Aldrich Chemical Co.) | 0.01 g. |
| Blue sensitizing dye (Euchrysine GGA-Allied Chemical) | 0.25 g. |
| Dispersed dye (Calcofast Spirit Blue THN-American Cyanamid) | 5.0 g. |
| Toluene | 230 ml. |

EXAMPLE 3

| Coating Composition (red dispersed dye) | |
|---|---|
| Photoconductive zinc oxide (Photox 80) | 100 g. |
| Modified acrylic resin (50% solids in toluene) (DeSoto resin E-202) | 100 g. |
| Green sensitizing dye (Ethyl Red #2155-Eastman Organic Chemicals) | 0.05 g. |
| Red sensitizing dye (EEBI-Aldrich Chemical Co.) | 0.01 g. |

-continued

| Coating Composition (red dispersed dye) | |
|---|---|
| Blue sensitizing dye (Euchrysine GGA-Allied Chemical) | 0.25 g. |
| Dispersed dye (Azozol Fast Brilliant Red BN-GAF) | 5.0 g. |
| Toluene | 230 ml. |

In preparing the foregoing coating compositions, the resinous binder, the zinc oxide and solvent are first blended to obtain a uniform mixture. The sensitizing dyes are then added and mixed, and finally the dispersed dye is added and mixed.

One of the above coating compositions is then coated on a suitable paper base sheet or the like by use of a roller coater, a metering rod or by hand draw-down with a wire wound rod in the desired coating weight and dried.

The resulting receptor sheet having a photoconductor coating on the face thereof is then charged as by subjecting the photoconductive coating to a corona spray as it is exposed to a corona discharge from wires operating at a potential of about 6000 to 8000 volts. The charged wires, which extend over the face of the receptor sheet, are either transported over the face of the receptor sheet, or the receptor sheet is displaced beneath the wires. An electrostatic charge is thus deposited over the entire receptor sheet covered by the photoconductive coating.

The charged receptor sheet is then exposed to light modified by an image, such as by projection of a photographic image of an original, which may be a black on white original, or a multi-color original, whereby the illuminated areas of the photoconductive coating on the receptor, corresponding to the non-imaged areas of the original, are rendered conductive. Thus, such illuminated areas are discharged to leave on the face of the receptor a latent electrostatic image on the photoconductive coating corresponding to the imaged portions of the original. Since the photoconductive coating of this embodiment of the invention has been panchromatically sensitized, the latent electrostatic image will include all of the images on the original, independent of their color.

The latent electrostatic image which is formed on the photoconductive coating is schematically illustrated in FIG. 1 of the drawing. As shown in this figure, the receptor sheet is formed of a conductive base sheet 10 having a photoconductive coating 12 formed from one of the coating compositions of Examples 1 to 3. The coating contains latent electrostatic images 14 and 14' on the face thereof after exposure to an original.

By way of illustration of the formation of the latent electrostatic image, suppose that the original to which the receptor of FIG. 1 is exposed contains images in the form of a red "A" and a blue "B" on a white background. Since the photoconductive coating is panchromatically sensitized, both the "A" and the "B" of the original appear in the form of a latent electrostatic image on the photoconductive coating. Since the photoconductor in the photoconductive coating is panchromatically sensitized, the areas on the photoconductive coating 14 and 14' are slightly discharged by illumination with red and blue light, respectively. However, the white background of the original provides illumination of much greater intensity whereby the portion of the photoconductive coating 12 corresponding to the non-imaged areas of the original are at substantially zero potential while the latent electrostatic image 14 and 14' retains at least a portion of the electrostatic charge after exposure to the original.

The exposed receptor sheet having latent electrostatic images 14 and 14' is then developed in a conventional manner, using a developer composition in the form of a solid or liquid composition containing a toner in the form of a material which, when in an activated state, serves as a solvent for the dispersed dye in the photoconductive coating 12, or as an adhesive for the photoconductive coating 12.

The following non-limiting examples will serve to illustrate liquid and solid developer compositions which can be used in the practice of this invention:

EXAMPLE 4

| Liquid Developer Composition | |
|---|---|
| Toner (antipyrine) | 5.0 g. |
| Liquid carrier (Isopar G) | 400 ml. |
| Charge director (Fuel Oil additive #2) | 5.0 g. |

EXAMPLE 5

| Liquid Developer Composition | |
|---|---|
| Toner (1-allyl-2-thiourea) | 5.0 g. |
| Liquid carrier (Isopar G) | 400 ml. |
| Charge director | 5.0 g. |

EXAMPLE 6

| Solid Developer Composition | |
|---|---|
| Micronized polyethylene (Microthene FN510-U.S.I. Chemicals) | 100% |

The liquid carrier used in the developer compositions of Examples 4 and 5 is Isopar G from Humble Oil and Refining Co., and is an aliphatic hydrocarbon solvent having a flash point of 104° F. In general, as the liquid carrier, use should be made of aliphatic hydrocarbon solvents in which the toner particles are insoluble.

The charge director, Fuel Oil Additive No. 2 from DuPont, is a solution of a methylmethacrylate copolymer having an average molecular weight of about 50,000 in kerosene. As will be apparent to those skilled in the art, any of a variety of conventional charge directors may be used.

The antipyrine of Example 4 and the 1-allyl-2-thiourea of Example 5 and the micronized polyethylene of Example 6 are merely representative of suitable toner particles which may be used for development of the latent electrostatic image remaining on the receptor face after exposure. Other toner particles may be used which meet the requirements:

(1) a solvent for the soluble dye component in the coating or an adhesive for the coating when the toner is in a molten or activated state;
(2) capable of being reduced to a finely divided form in which it is retained in the liquid or powdered developer composition;
(3) capable of taking on a charge, such as a positive charge when used with a charged photoconductive coating of zinc oxide;
(4) suitably located within the triboelectric series to produce the desirable charge development.

Representative of other suitable compounds which meet these requirements and can be used as toners are vanillin, 1,6-hexanediol, 1,10-decanediol, ammonium acetate, ethyl urea, acetamide, benzohydrol, 2,2-dimethyl-1,2-propanediol, ammonium formate and, pyrazine, all of which serve as solvents for the dispersed dye in an activated state, and a glycerol ester of rosin (Foral 30 from Hercules) a phenol-modified courmarone-indene resin (Nevillac Soft from Neville Chemical Co) and polystyrene (Piccolastic D-75 from Pennsylvania Industrial Chemical Corp) which, like the micronized polyethylene, serve as adhesives for the coating in an activated state.

It will be understood by those skilled in the art that all of the foregoing materials can be employed in the form of a solid developer composition. Similarly, the foregoing materials which are insoluble in a suitable liquid carrier of the type described can also be employed in the form of a liquid developer composition.

Figure 2:
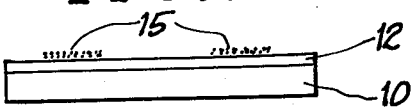
FIG. 2 is a sectional view of the receptor sheet of FIG. 1 after development of the latent electrostatic image with toner.

Upon development of the latent electrostatic images 14 and 14', the toner particles 15 are electrostatically attracted to the area of the face of the photoconductive coating 12 in a pattern corresponding to the pattern of images 14 and 14' as schematically illustrated in FIG. 2 of the drawing, while the discharged portions of the photoconductive coating 12 remain essentially free of toner particles.

Figure 3:
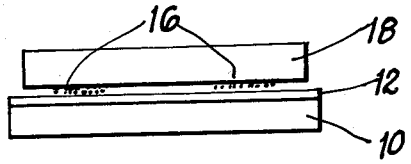
FIG. 3 is a schematic illustration of the transfer of the dye image on the face of the receptor sheet of FIG. 2 to a copy sheet.

Thereafter, the developed receptor sheet is pressed into surface contact with a copy sheet 18, as by passage of the composite assembly illustrated in FIG. 3 between compression rollers heated to a temperature above the melting point of the toner particles, such as a temperature above 111° to 113° C. which is a melting point for antipyrine, or above a temperature of 77° to 78° C. which is the melting point of 1-allyl-2-thiourea, and preferably by heating the toner particles to a temperature which exceeds their melting point by a slight amount, preferably 5° to 10° C.

When use is made of a toner which, when in activated or molten state, serves as a solvent for the dispersed dye in coating 12, the toner particles are reduced to a fluid state to thereby cause the fluid toner to dissolve the dispersed dye contained in coating 12 for transfer of the dye, as by diffusion, from the coating 12 to copy sheet 18.

When use is made of a toner which, when in an activated or molten state, serves as an adhesive for the photoconductive coating 12, the toner particles are reduced to a fluid state to thereby cause the imaged areas of the coating 12 to adhere to the copy sheet and form an image thereon having the color of the dispersed dye in the copy sheet.

Figure 4:
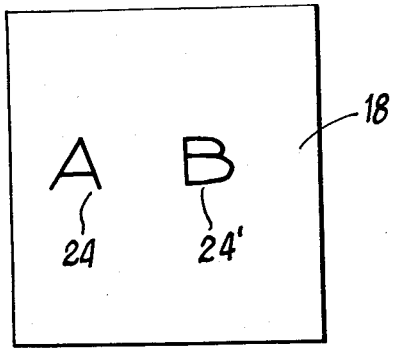
FIG. 4 is a plan view of the copy sheet of FIG. 3 having a dye image thereon.

In either case, the copy sheet is thus formed with a visible image 24 and 24' as shown in FIG. 4 corresponding to the images or the original. The color of images 24 and 24' corresponds to the color of the dispersed dye in coating 12, notwithstanding the color of the images on the original. Thus, when use is made of the coating composition of Example 1 in forming coating 12, the images 24 and 24' are black; with the compositions of Examples 2 and 3, the images of 24 and 24' are blue and red, respectively.

In accordance with another embodiment of this invention, the photoconductive coating 12 is formulated to contain a sensitizing component, preferably in the form of a sensitizing dye or dyes, which sensitizes the photoconductor to a portion of the visible spectrum. Thus, in this embodiment of the invention, the photoconductive coating 12 is selective, and forms an electrostatic image in response to only those colors of the original to which it has not been sensitized.

By way of illustration, the visible spectrum may be divided into contiguous segments, preferably three or more segments which together define the visible spectrum of 400 to 700 nm. Thus, the spectrum of visible light can be divided into segments of 400 to 500 nm, 500 to 600 nm and 600 to 700 nm which correspond approximately to the three primary additive colors of blue, green and red, respectively. The photoconductive coating is formulated to include a sensitizing dye which absorbs light falling within one of the foregoing segments of the visible spectrum and reflects light falling outside the range to which the photoconductor is sensitized. This effect can be achieved by the use of a dyestuff corresponding to one of the layers in the well known photographic processes based upon the substractive tri-pack.

The dispersed dye in the coating can still be any desired color, including black as well as the color of light which is reflected by the sensitizing dye.

For example, the photoconductor can be sensitized to absorb light within the range of 400 to 500 nm (blue sensitivity) and to reflect light within the range of 500 to 700 nm by the use of a dyestuff corresponding to the yellow layer of the substrative tri-pack, such as Euchrysine GGA or Auramine O dyes discussed above. If desired, the dispersed dye can be selected from dyes having a yellow color or a color representing the combination of the reflected light within the range of 500 to 700 nm.

Thus, when the receptor sheet having such a photoconductive coating is exposed to an original, all portions of the photoconductive coating 12 are discharged except those corresponding to areas of the original which only reflect light within the range of 500 to 700 nm. There is formed on the photoconductive coating 12 a latent electrostatic image corresponding to the image on the original having a color reflecting light within this range. Upon development, the image produced is yellow in color.

However, as indicated above, a dispersed dye having any desired color may be used in this embodiment of the invention. In the above coating, for example, use can be made of a black or blue dispersed dye to product black or blue images, respectively, on the copy sheet corresponding to the yellow imaged portions of the original.

The photoconductor can be sensitized to absorb light within the range of 500 to 600 nm (green sensitivity), while reflecting light within the range of 400 to 500 nm and 600 to 700 nm, by use of a dyestuff such as Acridine Red or Ethyl Red No. 2155 described above. When use is made of such green sensitive dyes, only the portions of the original reflecting light within the range of 400 to 500 nm and 600 to 700 nm to which the photoconductive coating is exposed result in the formation of a corresponding latent electrostatic image since other colors are absorbed by the coating to thereby discharge the receptor.

When using green sensitive dyes of the type described, use can be made of a dispersed dye having a blue-red (magenta) color corresponding to the combination of the reflected light within the range of 400 to 500 nm and 600 to 700 nm. Alternatively, use can be made of any other color such as black, blue, green, etc. The image thus produced corresponds to the color of the dispersed dye.

As a further example, the photoconductor can be sensitized to absorb light within the range of 600 to 700 nm (red sensitivity) while reflecting light within the range of 400 to 600 nm by use of a cyan coating in which the sensitizing component is EEBI or Patent Blue described above. When use is made of sensitizing dyes of this type, only portions of an original which reflect light within the range of 400 to 600 nm result in the formation of a latent electrostatic image.

As the dispersed dye, use can be made of a dispersed dye which has a color corresponding to the combination of the reflected light within the range of 400 to 600 nm, which is a blue-green (cyan) color. Alternatively, use can be made of other colors such as black, red, etc.

Having described the basic concepts of this embodiment of the invention, reference is made to the following examples of coating compositions for use in preparing the photoconductive coating 12 in the practice of this embodiment of the invention.

EXAMPLE 7

| Magenta Coating Composition (green sensitive) | |
|---|---|
| Photoconductive zinc oxide (Photox 80) | 100.0 g. |
| Modified acrylic resin (50% solids in toluene) (DeSoto resin E-202) | 80.0 g. |
| Green Sensitizing dye (Ethyl Red #2155) | 0.05 g. |
| Dispersed dye (Azosol Fast Brilliant Red BN) | 5.0 g. |
| Toluene | 250 ml. |

EXAMPLE 8

| Yellow Coating Composition (Blue sensitive) | |
|---|---|
| Photoconductive zinc oxide (Photox 80) | 100.0 g. |
| Modified acrylic resin (50% solids in toluene) (DeSoto resin E-202) | 80.0 g. |
| Blue sensitizing dye (Euchrysine GGA) | 0.5 g. |
| Dispersed dye (Calcofast Spirit Yellow TG) | 5.0 g. |
| Toluene | 250.0 ml. |

EXAMPLE 9

| Cyan Coating Composition (Red sensitive) | |
|---|---|
| Photoconductive zinc oxide (Photox 80) | 100.0 g. |
| Modified acrylic resin (50% solids in toluene) (DeSoto resin E-202) | 80.0 g. |
| Red sensitizing dye(EEBI) | |
| Dispersed dye (Calcofast Spirit Blue THN) | 5.0 g. |
| Toluene | 250.0 ml. |

EXAMPLE 10

| Black Coating Composition (Red sensitive) | |
|---|---|
| Photoconductive zinc oxide (Photox 80) | 100.0 g. |

-continued

| Black Coating Composition (Red sensitive) | |
|---|---|
| Modified acrylic resin (50% solids in toluene) (DeSoto resin E-202) | 80.0 g. |
| Red sensitizing dye(EEBI) | |
| Dispersed dye (Nigrosine SSB) | 5.0 g. |
| Toluene | 250.0 ml. |

Each of the foregoing compositions is prepared by employing the procedure described in reference to Examples 1 to 3.

One of the foregoing compositions is applied to a suitable receptor base sheet 10, such as Domtar 45 pound b.w. electrofax paper in the desired coating weight (15 to 17 pounds per 3,000 square feet of surface area), and dried.

The receptor base sheet 10 having the photoconductive coating 12 on the face thereof in which the photoconductor has been sensitized to a selected portion of the spectrum of visible light is then charged, imaged and developed in the manner described above. Upon development of the latent electrostatic image, the dye image can be transferred to any copy sheet including a transparent film or direct master as described.

By way of illustration, a receptor sheet having a photoconductive coating formed of the composition of Example 9 is given an electrostatic charge and exposed to an original having a red "A" and a blue "B" on a white background in a conventional manner. Since the photoconductor in the coating 12 is sensitized to absorb red light and reflect blue light, the portion of the coating 12 corresponding to the portion of the original defining the red "A" is discharged as well as the background portion of coating 12, while the area of coating 12 corresponding to the blue "B" of the original retains an electrostatic charge.

Upon development of the latent electrostatic image with one of the developer compositions of Examples 4 to 6 and transfer of the developed image to a copy sheet, a cyan-colored "B" is found on the copy sheet.

It will be understood by those skilled in the art that the spectrum of visible light may be divided into more than three segments as described above whereby the photoconductor is sensitized to an even narrower range or portion of the visible spectrum. Similarly, the photoconductor can be sensitized to a broader range or portion of the visible spectrum, preferably by the use of a combination of sensitizing dyes of the type described above. For example, use can be made of a combination of the green and red sensitizing dyes whereby the coating 12 absorbs light within the range of 500 to 700 nm and reflects light within the range of 400 to 500 nm.

It will be apparent that various changes and modifications can be made in the details of procedure, formulation and use without departing from the spirit of the invention, especially as defined in the following claims.

We claim:

1. An electrophotographic single color copy process comprising the steps of applying an electrostatic charge onto the face of a receptor formed of a substrate having on its face a single photoconductive coating comprising a photoconductor, at least one sensitizer which sensitizes the photoconductor to at least a portion of the spectrum of visible light, a binder and a dispersed dye, exposing the charged receptor to an original whereby portions of the photoconductive coating corresponding to the non-imaged areas of the original are discharged leaving a latent electrostatic image on the receptor, developing the exposed receptor with a developing composition containing a toner in the form of a material which, when in an activated state, is a solvent for the dispersed dye or an adhesive for the coating whereby toner is retained on the coating in areas retaining the electrostatic charge, and bringing a copy sheet in surface contact with the coating containing toner on the face thereof in a fluid state to cause transfer of the dispersed dye from the areas retaining the latent electrostatic charge to corresponding areas of the copy sheet.

2. A process as defined in claim 1 wherein the copy sheet is a transparent film.

3. A process as defined in claim 1 wherein the copy sheet is a duplicating master.

4. A process as defined in claim 1 wherein the photoconductor is photoconductive zinc oxide.

5. A process as defined in claim 1 wherein the photoconductive coating is present in a coating weight of 5–40 pounds per 3,000 square feet of surface area.

6. A process as defined in claim 1 wherein the coating containing 10–200 parts by weight binder per 100 parts by weight photoconductor.

7. A process as defined in claim 1 wherein the coating contains 0.001 to 5.0 parts by weight of the sensitizer per 100 parts by weight photoconductor.

8. A process as defined in claim 1 wherein the coating contains 0.5 to 20.0 parts by weight of the dispersed dye per 100 parts of photoconductor.

9. A process as defined in claim 1 wherein the toner is a material which, when in a molten state, is a solvent for the dispersed dye.

10. A process as defined in claim 9 wherein the toner is selected from the group consisting of antipyrine and 1-allyl-2-thiourea.

11. A process as defined in claim 1 wherein the toner is a material which, when in a molten state, is an adhesive for the coating containing dispersed dye.

12. A process as defined in claim 11 wherein the toner is micronized polyethylene.

13. A process as defined in claim 1 wherein the sensitizer sensitizes the photoconductor over substantially the entire spectrum of visible light.

14. A process as defined in claim 1 wherein the sensitizer is a combination of sensitizing dyes, each of which sensitize the photoconductor over a segment of the visible spectrum, with sufficient dyes to cover the entire visible spectrum.

15. A process as defined in claim 14 wherein the sensitizer is a combination of three sensitizing dyes which sensitize the photoconductor to each of the primary additive colors of red, blue and green.

16. A process as defined in claim 1 wherein the sensitizer is a sensitizing dye which sensitizes the photoconductor to a selected portion of the visible spectrum.

17. A process as defined in claim 16 wherein the sensitizer is a sensitizing dye which sensitizes the photoconductor to the additive primary color of red.

18. A process as defined in claim 16 wherein the sensitizer is a sensitizing dye which sensitizes the photoconductor to the additive primary color of blue.

19. A process as defined in claim 16 wherein the sensitizer is a sensitizing dye which sensitizes the photoconductor to the additive primary color of green.

20. A process as defined in claim 1 wherein the dispersed dye is a spirit soluble dye.

21. A process as defined in claim 1 wherein the dispersed dye is a pigment and the toner serves as an adhesive for the coating containing the pigment when in an activated state.

22. An electrophotographic single color copy process comprising the steps of applying an electrostatic charge onto the face of a receptor formed of a substrate having on its face a single photoconductive coating comprising a photoconductor, at least one sensitizer which sensitizes the photoconductor to at least a portion of the spectrum of visible light, a binder and a dispersed dye, exposing the charged receptor to an original whereby portions of the photoconductive coating corresponding to the non-imaged areas of the original are discharged leaving a latent electrostatic image on the receptor, developing the exposed receptor with a developing composition containing a toner in the form of a material which, when activated by heat solvent or vapor, is a solvent for the dispersed dye whereby toner is retained on the coating in areas retaining the electrostatic charge, and bringing a copy sheet in surface contact with the coating containing toner on the face thereof in a fluid state to cause transfer of the dispersed dye from the areas retaining the latent electrostatic charge to corresponding areas of the copy sheet.

* * * * *

UNITED STATES PATENT OFFICE

CERTIFICATE OF CORRECTION

Patent No. 4,077,802 Dated March 7, 1978

Inventor(s) LEO N. CHAPIN and YOUNG RHEE

It is certified that error appears in the above-identified patent and that said Letters Patent are hereby corrected as shown below:

Column 10, line 58, in Example 9, the line should read:

-- Red sensitizing dye(EEBI) 0.025 g. --

Column 11, line 6, in Example 10, the line should read:

-- Red sensitizing dye(EEBI) 0.05 g. --

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*